US006325592B1

(12) United States Patent
Meier

(10) Patent No.: US 6,325,592 B1
(45) Date of Patent: Dec. 4, 2001

(54) METHOD AND DEVICE FOR REMOVING PRINTED PRODUCTS FROM A CONVEYING STREAM AND FOR STACKING THE REMOVED PRINTED PRODUCTS

(75) Inventor: Jacques Meier, Baeretswil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/055,473

(22) Filed: Apr. 6, 1998

(30) Foreign Application Priority Data

Apr. 7, 1997 (CH) ..... 1997 0800/97

(51) Int. Cl.[7] ..... B65G 57/00

(52) U.S. Cl. ..... 414/790.5; 414/788.1; 198/803.7

(58) Field of Search ..... 414/798.2, 798.8, 414/788.1, 790.5; 198/803.7, 803.8, 803.9; 271/204–6, 300, 207, 209, 212, 213; 270/52.2

(56) References Cited

U.S. PATENT DOCUMENTS

| | | | | |
|---|---|---|---|---|
| 3,208,604 | * | 9/1965 | Taylor et al. | 414/798.2 |
| 3,566,757 | * | 3/1971 | Fujishiro | 414/790.5 |
| 3,951,399 | * | 4/1976 | Reist | 270/52.2 |
| 4,039,182 | | 8/1977 | Reist et al. | 271/64 |
| 4,046,367 | * | 9/1977 | Merker et al. | 270/52.2 |
| 4,162,733 | * | 7/1979 | Wiseman | 414/790.5 |
| 4,274,792 | * | 6/1981 | Roth et al. . | |
| 4,381,056 | | 4/1983 | Eberle | 198/696 |
| 4,445,681 | | 5/1984 | Reist | 271/300 |
| 4,477,067 | * | 10/1984 | Wise | 270/52.2 |
| 4,514,128 | * | 4/1985 | Hedrick | 414/790.5 |
| 4,666,143 | * | 5/1987 | Reist | 271/204 |
| 4,683,708 | | 8/1987 | Linder | 53/540 |
| 4,706,951 | | 11/1987 | Leu | 270/55 |
| 4,801,132 | * | 1/1989 | Reist | 271/204 |
| 5,104,108 | * | 4/1992 | Honegger | 270/52.2 |
| 5,110,108 | * | 5/1992 | Muller . | |
| 5,370,382 | * | 12/1994 | Wetter | 271/204 |
| 5,388,820 | | 2/1995 | Eberle et al. | 198/803.9 |
| 5,395,151 | | 3/1995 | Eberle | 294/104 |
| 5,755,436 | * | 5/1998 | Reist | 271/204 |

FOREIGN PATENT DOCUMENTS

| | | | | |
|---|---|---|---|---|
| 249427 | * | 1/1964 | (AU) | 271/204 |
| 2822060 | * | 12/1978 | (DE) | 271/204 |
| 440157 | * | 12/1935 | (GB) | 271/204 |

* cited by examiner

*Primary Examiner*—Robert P. Olszewski
*Assistant Examiner*—Steven B. McAllister
(74) *Attorney, Agent, or Firm*—Rankin, Hill, Porter & Clark LLP

(57) ABSTRACT

In a method for removing printed products (2) from a conveying stream and for forming stacks of the removed printed products (2), the conveying stream is a stream of printed products (2) held by a gripper in a hanging position and conveyed in a direction substantially perpendicular to their main surfaces. For removing the printed products (2) from the conveying stream and for stacking them, the printed products held by the gripper (1) are conveyed over a stacking surface (4) which protrudes into the conveying stream such that a lower region of each printed product (2) conveyed in the conveying stream is laid against the stacking surface (4) or against a printed product already lying against the stacking surface (4), respectively. Printed products (2) to be removed from the stream are released by the gripper (1) in the region of the stacking surface (4) and fall, guided by the stacking surface (4) or by printed products already lying against the stacking surface (4) respectively, against a support base (5) which is arranged at the bottom of the stacking surface so that the products are stacked on the stacking surface and supported by the support base.

5 Claims, 3 Drawing Sheets

METHOD AND DEVICE FOR REMOVING PRINTED PRODUCTS FROM A CONVEYING STREAM AND FOR STACKING THE REMOVED PRINTED PRODUCTS

FIELD OF THE INVENTION

The invention concerns a method and device for removing printed products from a conveying stream and for forming stacks of one or more of the removed printed products.

BACKGROUND OF THE INVENTION

During processing, such as between successive processing stations, printed products are usually transported in streams. In such conveying streams, the printed products e.g. lie one after the other or overlapping each other (scaled stream) on a conveying surface and are conveyed in a direction substantially parallel to their main surfaces (the largest surfaces of the products) or else the printed products are individually held in a hanging position, e.g. by grippers, so that their main surfaces are substantially perpendicular to the conveying direction.

Printed products are collected in stacks for different kinds of processing (intermediate storage, packing) and are further conveyed and/or processed in the form of stacks (bundles, handleable stacks or packages).

Usually, a stacking device forms the end of a conveying stream, i.e. all printed products conveyed in a conveying stream are stacked by the device. The capacity of a device for further conveying or processing the stacks is to be adapted to the conveying capacity of the conveying stream or else switch points must be introduced into the conveying stream which guide the products to a plurality of parallel stacking devices. The number of printed products which a device for further conveying or further processing (e.g. for strapping or packaging) of stacks is able to handle per time unit is substantially constant and supplying the products causes no problems as long as all stacks to be produced contain a substantially equal number of printed products. If, however, stacks containing very different numbers of printed products are to be produced (e.g. standard packages and odd packages or packages of standard size consisting of printed products with different thicknesses) the capacity of the stack-processing devices regarding number of printed products being taken in by them is subject to very fast changes. Thus, difficulties arise which are additionally increased if the stack-forming must be adapted to the characteristics of the individual printed products (individualized printed products).

In publication CH-667854 (or U.S. Pat. No. 4,683,708) a plant is described for selectively dropping printed products supplied in a scaled stream into a stacking shaft or for conveying them further to a further stacking device. In the further stacking device, the stacks are formed and immediately packed into film and are then conveyed away. The plant can only be used if the major part of printed products is dropped into the stacking shaft or if the conveying performance of the supply stream is adapted to the momentary capacity of both stacking devices but especially of the further stacking device. Using the described plant it is not possible to remove individual printed products from the scaled stream for dropping them into the stacking shaft, i.e. it is not possible to handle individualized printed products individually. For these reasons the described plant is restricted to a very narrow range of application.

SUMMARY OF THE INVENTION

An object of the invention is to provide a method with which individual printed products or groups of successive printed products can be removed from a conveying stream of printed products in a predetermined manner and can be supplied to further processing either individually or as stacked groups. The method is simple and adaptable to the most various conditions. Furthermore, an object of the invention is to provide a device for carrying out the inventive method.

Briefly described, the invention comprises a method for removing printed products from a conveying stream having a conveying direction and for forming stacks of the removed printed products wherein each stack consist of one or a plurality of printed products. The printed products are conveyed in the stream with each printed product held by holding means in a hanging position and with the largest, or main, surfaces of the printed products substantially perpendicular to the conveying direction. The printed products are conveyed over a stacking surface which protrudes into the conveying stream such that a lower region of each product conveyed in the conveying stream is laid against the stacking surface or against a printed product already lying against the stacking surface. Printed products to be removed from the conveying stream are released from the holding means in the region of the stacking surface whereby each released printed product is guided by the stacking surface or a printed product already lying against the stacking surface and drops onto a support base below the stacking surface to form a stack on the stacking surface supported by the support base.

For transporting away a stack formed on the stacking surface, the support base is e.g. removed and the printed product or products on the support base fall due to gravity to further processing, e.g. into a device for packaging the stack between webs of film. For transporting away a stack formed on the stacking surface (this stack consisting of one or of a plurality of printed products), this stack can also be pushed off the stacking surface laterally.

The selected removal of printed products from a stream and the stacking of the removed printed products may form one only method step. This means that products which are not to be removed from the stream are not dropped from the gripping means in the region of the stacking surface but are conveyed past, hanging on the gripping means and thus being drawn over the stacking surface.

However, the selective removal of printed products from the stream and the stacking of the products may also be carried out in two separate steps. In that case, a switch point is provided upstream of the stacking surface, where the printed products to be removed are diverted and conveyed still hanging from the holding means towards the stacking surface while the printed products not to be removed are conveyed away in the original conveying stream. In this embodiment of the inventive method it is also possible to buffer the printed products between the switch point and the stacking surface in order to bridge bottlenecks in the further processing of the stacks.

BRIEF DESCRIPTION OF THE DRAWINGS

The inventive method and device are described in more detail with reference to the following Figures, wherein.

DESCRIPTION OF PREFERRED EMBODIMENTS

Figure 1:
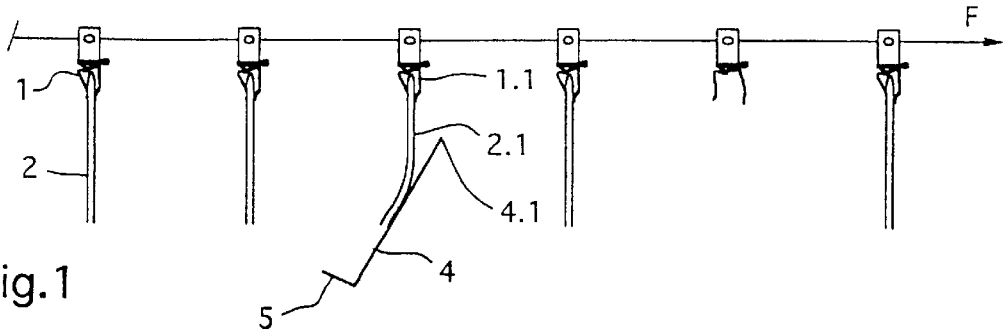
FIGS. 1 to 4 are schematic side elevation diagrams showing the functional principle of the inventive method.

FIGS. 1 to 4 schematically show the functional principle of the inventive method by means of successive stages of a conveying stream with a conveying direction F. In the conveying stream, printed products 2 held in hanging positions by holding means 1 are conveyed with their main surfaces substantially perpendicular to the conveying direction. Individual printed products 2 are removed from the conveying stream and are conveyed away as a stack 3. For this purpose, a stacking surface 4 protrudes into the conveying stream from below. An upper edge 4.1 of the stacking surface lies in a plane parallel with the main surfaces of the printed products. On the bottom edge of the stacking surface, which is positioned below the conveying stream, is a support base 5. Stacking surface 4 can be oriented in a vertical plane or it can be oblique with its upper edge further downstream than its bottom edge relative to conveying direction F.

FIG. 1 shows a sector of the conveying stream in a stage in which one printed product 2.1, which is held hanging by one holding means 1.1, has reached a position in which it lies against the stacking surface 4. Printed product 2.1 is not to be removed from the stream. For this reason, holding means 1.1 passes the point above the stacking surface without releasing the product and the printed product 2.1 is drawn over the stacking surface.

Figure 2:
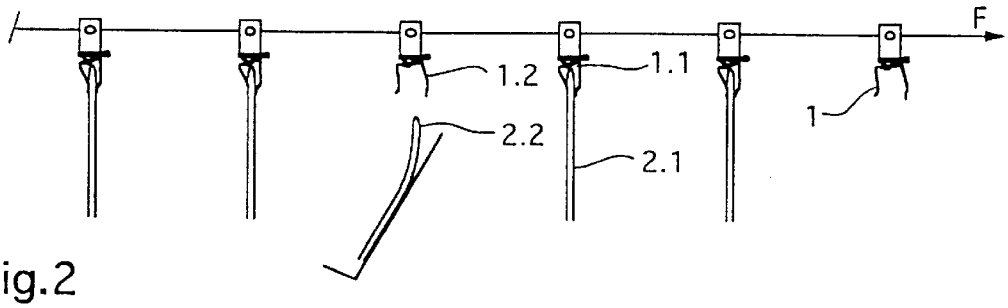

FIG. 2 shows printed product 2.1 having passed stacking surface 4 and being conveyed away. The following printed product 2.2, which is conveyed by the holding means 1.2, has now reached the stacking surface 4. Because printed product 2.2 is to be removed from the stream, holding means 1.2 is opened and printed product 2.2 falls downward, guided by the stacking surface 4, until it reaches the support base 5 and remains standing there (FIG. 3).

Figure 3:
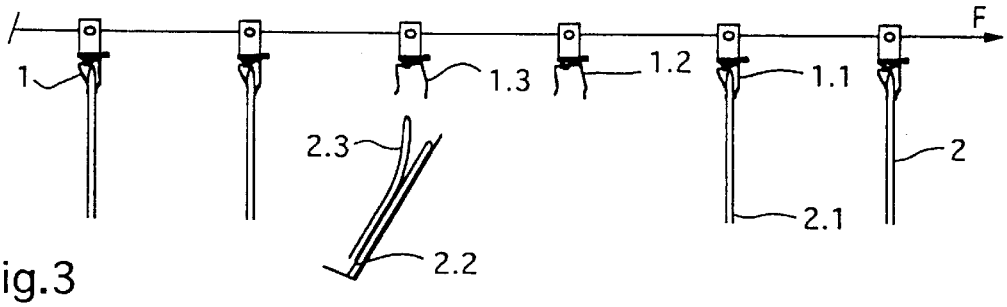

FIG. 3 shows how a further succeeding printed product 2.3 is deposited on the stacking surface or on the printed product already lying against the stacking surface by opening the holding means 1.3.

Figure 4:
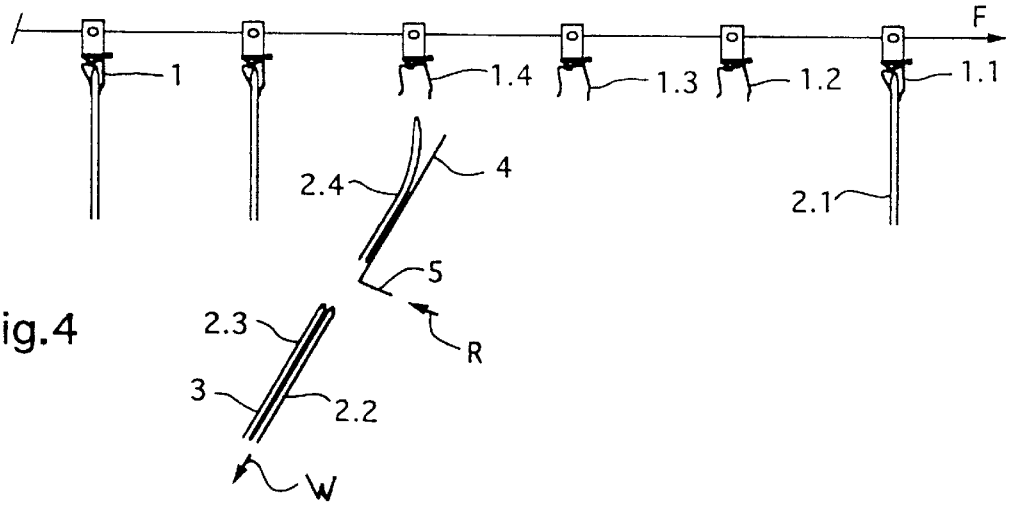

FIG. 4 shows how, by shifting the support base 5, the stack 3, which has formed on the stacking surface 4 and which consists of the printed products 2.2 and 2.3 in the shown example, is conveyed away by gravity (arrow W), for which conveying away a suitable guidance is advantageously provided (not shown). Thus, the stacking surface becomes empty again and when the support base 5 is brought back into its original position (arrow R) it is again ready to form a new stack which e.g. begins with the shown removal of the succeeding printed product 2.4.

Naturally, instead of stacks which consist of a plurality of printed products, individual printed products (stacks of only one printed product each) can be conveyed away from stacking surface 4 for further processing.

In each of FIGS. 1 to 4, a sector of a conveying stream is shown. It is easily possible to arrange a further stacking surface downstream of the one shown in the Figures or a series of further stacking surfaces onto which printed products which are not removed at the first stacking surface are dropped and stacked.

In FIGS. 1 to 4, the printed products are shown diagrammatically as sheets folded once with a folding edge which is oriented upwards, i.e. is held by the holding means. In similar manner, different printed products can be handled also, printed products which e.g. consist of several sheets folded inside each other or multi-page printed products which are stitched or bound, whereby these products can be conveyed with their folded edge or stitched or bound spine respectively directed upwards, downward or to one side.

The main advantage of the inventive method as shown in FIGS. 1 to 4 is its simplicity and the fact that the device necessary for carrying out the method is also extremely simple.

This device substantially comprises a conveying line which is e.g. designed as a transport chain with grippers for hanging conveyance of individual printed products and of one stacking surface or a plurality of stacking surfaces having a movable or shiftable support base or different suitable means for removing a stack formed on the stacking surface. Furthermore, controlling means are provided for opening grippers in a position in the region over the stacking surface and possibly guiding means with which printed products are guided out of opened grippers, such guiding means preventing uncontrolled dragging of printed products to be removed by the grippers. This kind of guiding means is e.g. a guiding template or guiding band which is moved into the conveying stream for products to be removed (see FIG. 5) or which is stationary for cases in which all printed products are to be removed from the stream.

Figure 5:
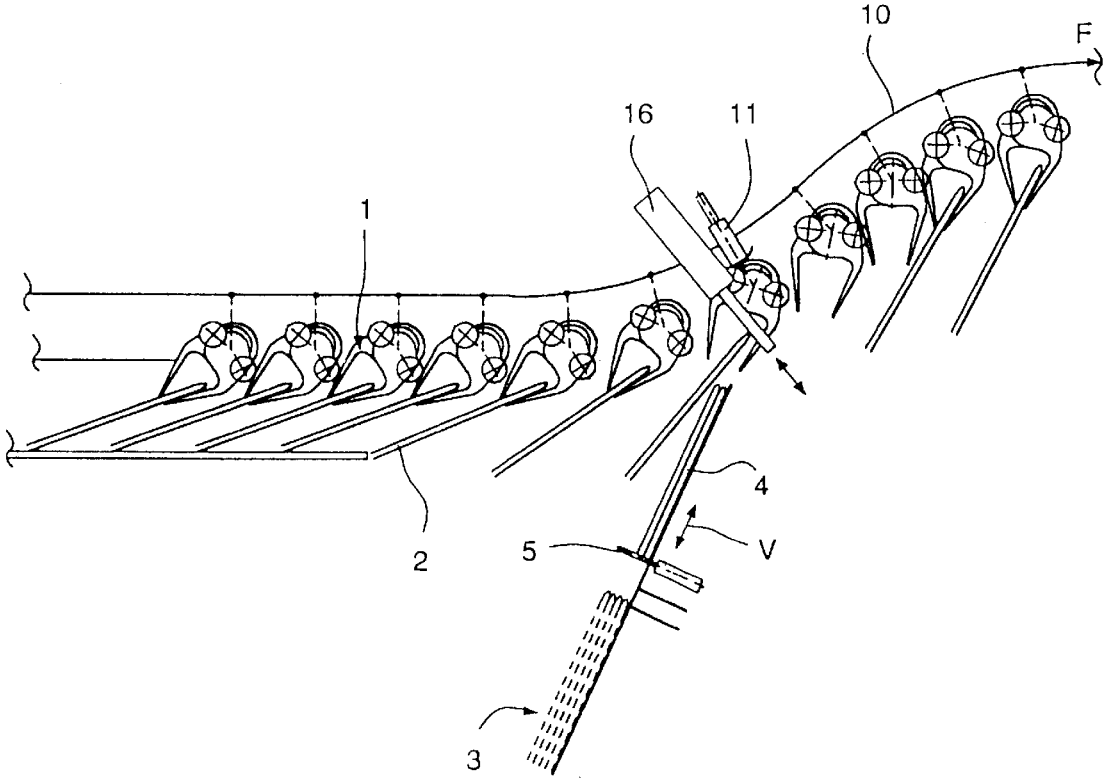
FIGS. 5 and 6 are more detailed schematic side elevations of two embodiments of devices for carrying out the inventive method.

FIG. 5 shows an embodiment of a device for carrying out the inventive method. This embodiment comprises a chain 10 (shown as a single line) which is moved along the conveying line in the conveying direction F. Equidistant grippers (holding means 1) are mounted on chain 10 and hold folded printed products 2 which are thereby conveyed in a hanging position over a stacking surface 4. Means 11 for opening the grippers are installed above the stacking surface 4, which means 11 are controllable for selectively opening predetermined grippers.

The conveying line (path of transport chain 10) may turn upwards for facilitating the further conveying of printed products not to removed, as is shown in FIG. 5.

Stacking surface 4 and support base 5 of the device, as shown in FIG. 5, correspond to the stacking surface and the support base in FIGS. 1 to 4. Again, for facilitating the conveying away of the printed products not removed from the stream, the stacking surface 4 can be arranged to be movable up and down (e.g. parallel to its orientation), as is indicated by double arrow V. A stacking surface thus moveable is moved into an upper position for a printed product to be removed and into a lower position for a printed product not to be removed for which purpose it is functionally coupled to a suitably controlled drive.

FIG. 5 also shows guiding means 16 for guiding the printed products to be removed from the stream out of the opened grippers. These guiding means are designed such that they are movable into the conveying stream for printed products to be removed and are movable out of the conveying stream for printed products not to be removed. The guiding means is e.g. designed as a pair of guiding cylinders which are arranged on opposite sides of the grippers and in their extended positions (FIG. 5) guide a printed product out of an opened gripper and in their rest position do not interfere with printed products not to be removed.

Chains with grippers and control means for opening the grippers, as shown diagrammatically in FIG. 5, are e.g. described in the publications CH-644816 (or U.S. Pat. No. 4,381,056), EP-0 557 680 (or U.S. Pat. No. 5,388,820) or U.S. Pat. No. 5,395,151 and for this reason need not be described here in detail. The same is true for guiding means for guiding printed products to be removed out of opened grippers which are e.g. described in publications CH-648261 (or U.S. Pat. No. 4,445,681) or CH-654 275.

Figure 6:
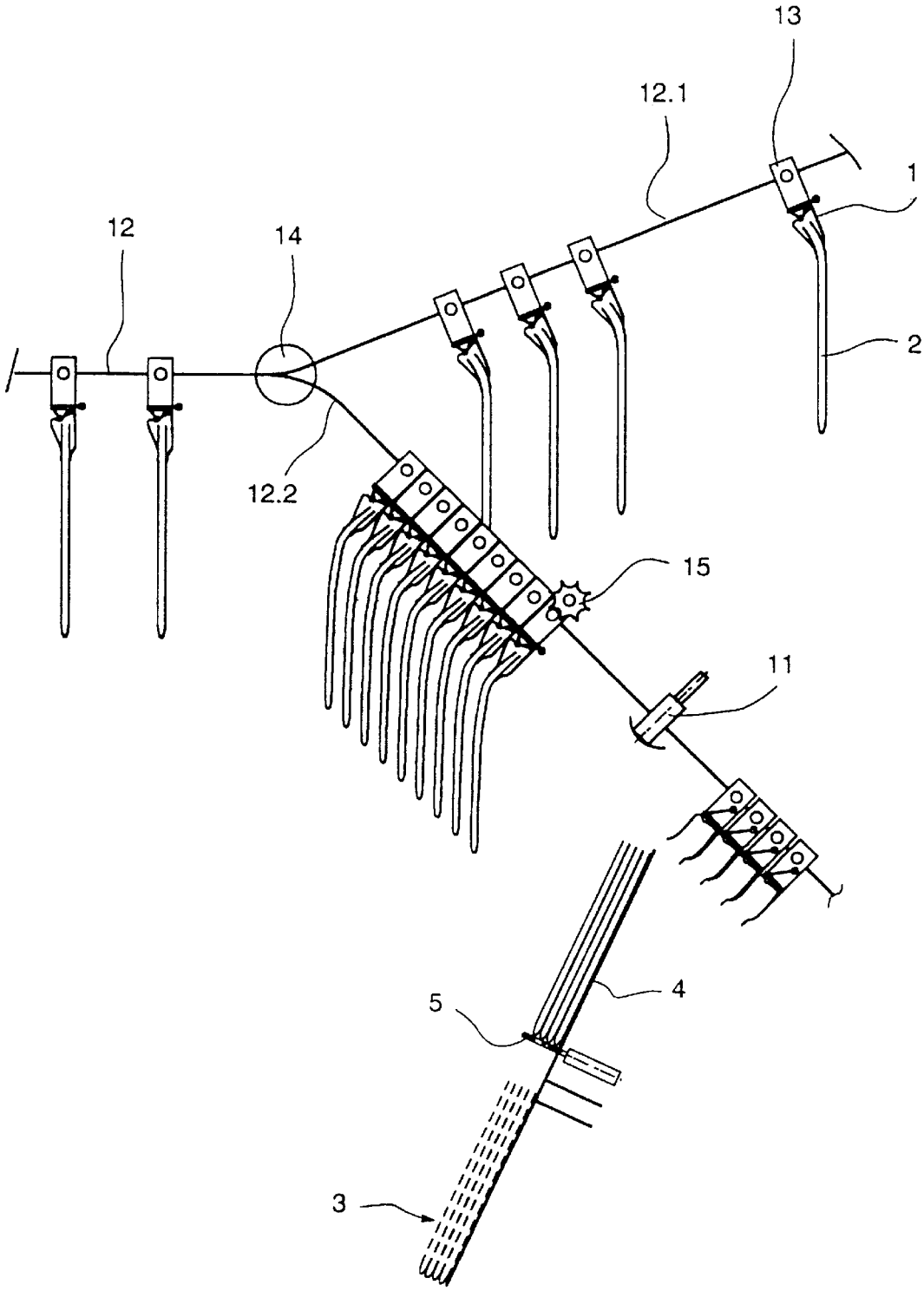

FIG. 6 shows a further embodiment of a device for carrying out the inventive method. In this case, the conveying line is designed as a rail 12 or arrangement of rails (shown diagrammatically as a line) on which individual transport means 13 are individually transportable. Each transport means carries a holding means 1, e.g. a gripper. At a controlled switch point 14, rail 12 branches into a rail 12.1 for conveying away transport means with holding means holding printed products not to be removed from the stream, and into a rail 12.2 leading over the stacking surface. Transport means conveying printed products to be removed from the stream are guided onto rail 12.2.

Rail 12.2 can e.g. be directed downward and comprise controllable stopping means 15, e.g. in form of a controllable wheel for clocked releasing and counting, which locking means stops and buffers transport means conveyed towards it by gravity and releases them according to need towards means 11 for opening the holding means 1. As only printed products to be removed and to be stacked on the stacking surface 4 are conveyed on rail 12.2, all gripping means must be opened over the stacking surface, so that means 11 for opening must not be selectively controlled. Means 11 can e.g. be designed as a control template which co-operates with corresponding control rolls on the holding means.

The stacking surface shown in FIG. 6 substantially corresponds to the stacking surface as described in connection with FIGS. 1 to 4. Because, according to the embodiment shown in FIG. 6, no printed products not to be removed from the conveying stream are to be drawn over the stacking surface 4, the surface can occupy a position which is optimal for removing but would render drawing-over difficult or even impossible.

Systems of rails, switch points and transport means with holding means running individually on these are described in publications CH-382 768 (or U.S. Pat. No. 3,032,341), CH-569 197 (or U.S. Pat. No. 3,948,551), CH-596 061 (or U.S. Pat. No. 4,039,182) or in Swiss patent applications 1816/96 and 1818/96 and for this reason need not be described in further detail here.

What is claimed is:

1. A device for selectively removing printed products (2) from a conveying stream of printed products and for stacking removed printed products, the device comprising:

conveying and holding means for serially conveying the printed products, each printed product being held near its upper edge in a hanging position, a lower edge of the printed products defining a lower limit of the conveying stream;

a stationary planar stacking surface comprising a top edge and a bottom edge and a support base mounted along the bottom edge, the stacking surface being oriented substantially parallel to the upper edges of the printed products being conveyed, said stacking surface also being oriented generally vertically or at an oblique angle such that the stacking surface top edge is positioned, relative to the conveying stream, further downstream than the stacking surface bottom edge, said stacking surface protruding from below into the conveying stream, the top edge being positioned above the lower limit of the conveying stream, the top edge being positioned below the conveying stream lower limit, whereby a lower part of each product in the conveying stream is positioned against a top part of the stacking surface when it is conveyed to the stacking surface; and, control means for selectively releasing selected ones of the products form said conveying and holding means when the lower part of the product is positioned against the top part of the stacking surface or against products already stacked against the stacking surface, said released product sliding downwardly toward said support base.

2. A device according to claim 1 wherein said support base is movable relative to said support surface for releasing products stacked against and supported by the support base (5).

3. A device according to claim 1 wherein said control means comprises means for deactivating selective ones of the holding means in a position above said stacking surface.

4. A device according to claim 1 wherein said holding means (1) are independent of each other, said control means including a switch point (14) upstream of said stacking surface (4) for switching selective ones of the holding means to be conveyed toward the stacking surface, and means for deactivating all said selected ones of said holding means in a position above the stacking surface.

5. A device according to claim 1 wherein each said holding means (1) is a gripper that is opened upon deactivation.

* * * * *

UNITED STATES PATENT AND TRADEMARK OFFICE

CERTIFICATE OF CORRECTION

PATENT NO. : 6,325,592 B1
DATED : December 4, 2001
INVENTOR(S) : Meier

It is certified that error appears in the above-identified patent and that said Letters Patent is hereby corrected as shown below:

Column 3,
Line 8, after “4.1”, insert -- (substantially perpendicular to the paper plane) --.

Column 6,
Line 12, delete “top” and insert -- bottom --.
Line 19, delete “form” and insert -- from --.

Signed and Sealed this

Tenth Day of December, 2002

JAMES E. ROGAN
*Director of the United States Patent and Trademark Office*